US006640939B2

(12) United States Patent
Buck

(10) Patent No.: US 6,640,939 B2
(45) Date of Patent: Nov. 4, 2003

(54) SNUBBING UNIT WITH IMPROVED SLIP ASSEMBLY

(76) Inventor: David A. Buck, 1348 Sawmill Hwy., Breaux Bridge, LA (US) 70517

( * ) Notice: Subject to any disclaimer, the term of this patent is extended or adjusted under 35 U.S.C. 154(b) by 0 days.

(21) Appl. No.: 09/998,449

(22) Filed: Nov. 30, 2001

(65) Prior Publication Data

US 2003/0066718 A1 Apr. 10, 2003

Related U.S. Application Data

(63) Continuation-in-part of application No. 09/973,282, filed on Oct. 9, 2001.

(51) Int. Cl.[7] ..... B65H 59/10

(52) U.S. Cl. ..... 188/67; 175/423; 173/164; 166/77.53; 81/57.19

(58) Field of Search ..... 188/67, 265; 175/423; 173/164, 167; 81/57.19; 166/77.53, 78.1

(56) References Cited

U.S. PATENT DOCUMENTS

| | | | | | |
|---|---|---|---|---|---|
| 3,571,865 | A | | 3/1971 | Johnson | 24/263 |
| 3,579,752 | A | * | 5/1971 | Brown | 188/67 |
| 3,722,603 | A | * | 3/1973 | Brown | 173/159 |
| 4,306,339 | A | | 12/1981 | Ward | 24/263 |
| 4,332,062 | A | * | 6/1982 | Byrne, Jr. | 188/67 |
| 4,355,443 | A | | 10/1982 | Blackwell | 24/263 |
| 4,381,584 | A | * | 5/1983 | Coyle, Sr. | 188/67 |
| 4,681,193 | A | * | 7/1987 | Crowe | 188/67 |
| 4,715,456 | A | * | 12/1987 | Poe, Jr. et al. | 188/67 |
| 5,819,605 | A | | 10/1998 | Buck et al. | 81/57.33 |
| 5,911,796 | A | | 6/1999 | Buck | 81/57.33 |
| 5,992,801 | A | * | 11/1999 | Torres | 188/67 |
| 6,089,338 | A | * | 7/2000 | Bouligny, Jr. | 175/423 |
| 6,223,629 | B1 | * | 5/2001 | Bangert | 81/57.15 |
| 6,386,284 | B1 | * | 5/2002 | Buck et al. | 166/77.53 |
| 6,394,201 | B1 | * | 5/2002 | Feigel, Jr. et al. | 175/423 |

FOREIGN PATENT DOCUMENTS

| | | |
|---|---|---|
| WO | WO 98/10899 | 3/1998 |

* cited by examiner

*Primary Examiner*—Jack Lavinder
*Assistant Examiner*—Mariano Sy
(74) *Attorney, Agent, or Firm*—Jones, Walker, Waechter, Poitevent, Carrere & Denegre, L.L.P.

(57) ABSTRACT

An improved snubbing unit including a snubbing unit base, a lifting assembly having a platform positioned above the base, a rotary table positioned on the snubbing unit, and a first slip assembly positioned on the rotary table. The first slip assembly further includes a base plate with a center aperture formed therein, at least two separate slip frames positioned on the base plate around the center aperture, wherein each of the slip frames includes a slip surface, and a die carrier positioned within each of the slip frames, wherein each of the die carriers also includes a surface for engagement with the slip surfaces of said slip frames. Additionally, a second slip assembly will be positioned on the snubbing unit.

13 Claims, 14 Drawing Sheets

SNUBBING UNIT WITH IMPROVED SLIP ASSEMBLY

This is a continuation-in-part of Ser. No. 09/973,282, filed on Oct. 9, 2001, to which this application claims priority and which is hereby incorporated by reference in its entirety.

I. BACKGROUND OF THE INVENTION

The present invention relates to slip assemblies used in the oil and gas drilling industry. In particular, the present invention relates to an improved slip surface which allows the die carriers of the slip assembly to apply greater radial force to the tubular member being gripped.

Various types of slip assemblies are known in the art. U.S. Pat. No. 4,681,193 to Crowe discloses a typical slip assembly which is operated with hydraulic cylinders. The Crowe slip assembly has a slip bowl with an open top and bottom and which has an inwardly sloping slip surface of a continuous curvature around the inside parameter of the bowl. In essence, the slip bowl forms a funnel shaped slip surface. A plurality of slip die carriers (e.g., three) are designed to fit within the slip bowl. Each of the die carriers will include a sloping arcuate surface which has a curvature corresponding to the curvature of the bowl's slip surface. However, it will be understood that this correspondence between the slip bowl's surface and the die carrier's slip surface occurs only at a single location on the slip bowl. As is well known in the art, as the die carriers ride down the bowl's sloping slip surface, the die carriers are moved radially inward in order to engage a tubular member projecting through the center of the bowl. Likewise, raising the die carriers in the bowl allows the die carriers to move away from the tubular, thereby releasing the tubular. Typically, slip assemblies are employed in conjunction with a secondary type of tubular gripping and lifting device. The lifting device will grip and lift the tubular member. The slip assembly with will then engage the tubular member so that the lifting device may release the tubular member and grip the tubular member in a lower position in preparation for another lift.

It is common in the drilling industry to handle tubulars having slight variations in diameter do due to machining tolerances, scarring on the tubular's outer skin, or other wearing of the tubular surface. While these variations are not great in magnitude, they do often create a problem in relation to the prior art slip assembly. The prior art does allow for the use of different die carriers for different standard tubular diameters. However, because the slip surface of the prior art bowl is in essence funnel shaped, the tubular must be virtually the exact standard diameter in order to allow the die carrier's rear surface to perfectly match the bowl surface along the entire slope of the slip surface. Nevertheless, there is almost always some variations in diameter from tubular to tubular. This results in the die carriers not uniformly contacting the slip bowl, thus resulting in die carriers not applying uniform force to the tubulars or the die carriers having a tendency to "rock" in the slip bowl. Both of these problems are detrimental to the effective and non-damaging gripping of tubulars.

Another disadvantage of prior art slip bowls is the comparatively high coefficient of friction (COF) between the die carrier's and the bowl's slip surfaces. Viewing FIG. 1A, slips may be conceptualized as two inclined planes sliding against one another. Block 4A would represent the slip bowl surface and block 4B would represent the inclined surface on the die carrier. The angle alpha ($\alpha$) of the slip surface seen in FIG. 1A will typically be approximately 80 degrees. It will be understood that the force generated by the COF ($F_f$ in FIG. 1A) has a component ($F_x$) which acts in the opposite direction of the radial force ($F_A$) used to grip the tubular. Therefore, the higher the COF on the slip surface, the lower the amount of radial force available for the die carrier to utilize in gripping the tubular. Normally, the COF of this steel on steel contact is approximately 0.08. It would be a significant advance in the art to provide a slip assembly which substantially reduced the COF on the slip surfaces and applied more gripping force to the tubular member.

It would also be advantageous to supply an improved slip assembly which would allow the slip assembly to be mounted on a rotary table or the like and to provide rotational force or torque to the tubular member by way of the slip assembly. This is not easily carried out with the prior art slip assemblies such as seen in the Crowe reference because the die carriers are not firmly fixed in the slip bowl against lateral movement as torque is applied.

II. SUMMARY OF THE INVENTION

The present invention comprises an improved slip assembly. The slip assembly has a base and at least two opposing slip frames positioned on the base with each of the slip frames including a planar slip surface. Additionally, a die is carrier positioned within each of the slip frames and each of the die carriers also includes a planar surface which engages the slip surfaces of the slip frames.

The present invention also includes a low friction slip assembly having a base and at least two opposing slip frames positioned on the base. Each of the slip frames will include a slip surface having an effective coefficient of friction less than about 0.07 and die carriers will be position within each of the slip frames.

The present invention further includes an improved slip assembly which has a base plate with a center aperture formed therein. There will be at least two separate slip frames positioned around the center aperture and each of the slip frames will include a slip surface. A die carrier will be positioned within each of the slip frames and each of the die carriers will include a surface for engagement with the slip surfaces of the slip frames.

The present invention still further comprises an improved snubbing unit including a snubbing unit base, a lifting assembly having a platform positioned above the base, a rotary table positioned on the snubbing unit, and a first slip assembly positioned on the rotary table. The first slip assembly will further include a base plate with a center aperture formed therein, at least two separate slip frames positioned on the base plate around the center aperture, wherein each of the slip frames includes a slip surface, and a die carrier positioned within each of the slip frames, wherein each of the die carriers also includes a surface for engagement with the slip surfaces of said slip frames. Additionally, a second slip assembly will be positioned on the snubbing unit.

III. BRIEF DESCRIPTION OF THE DRAWINGS

Figure 4:
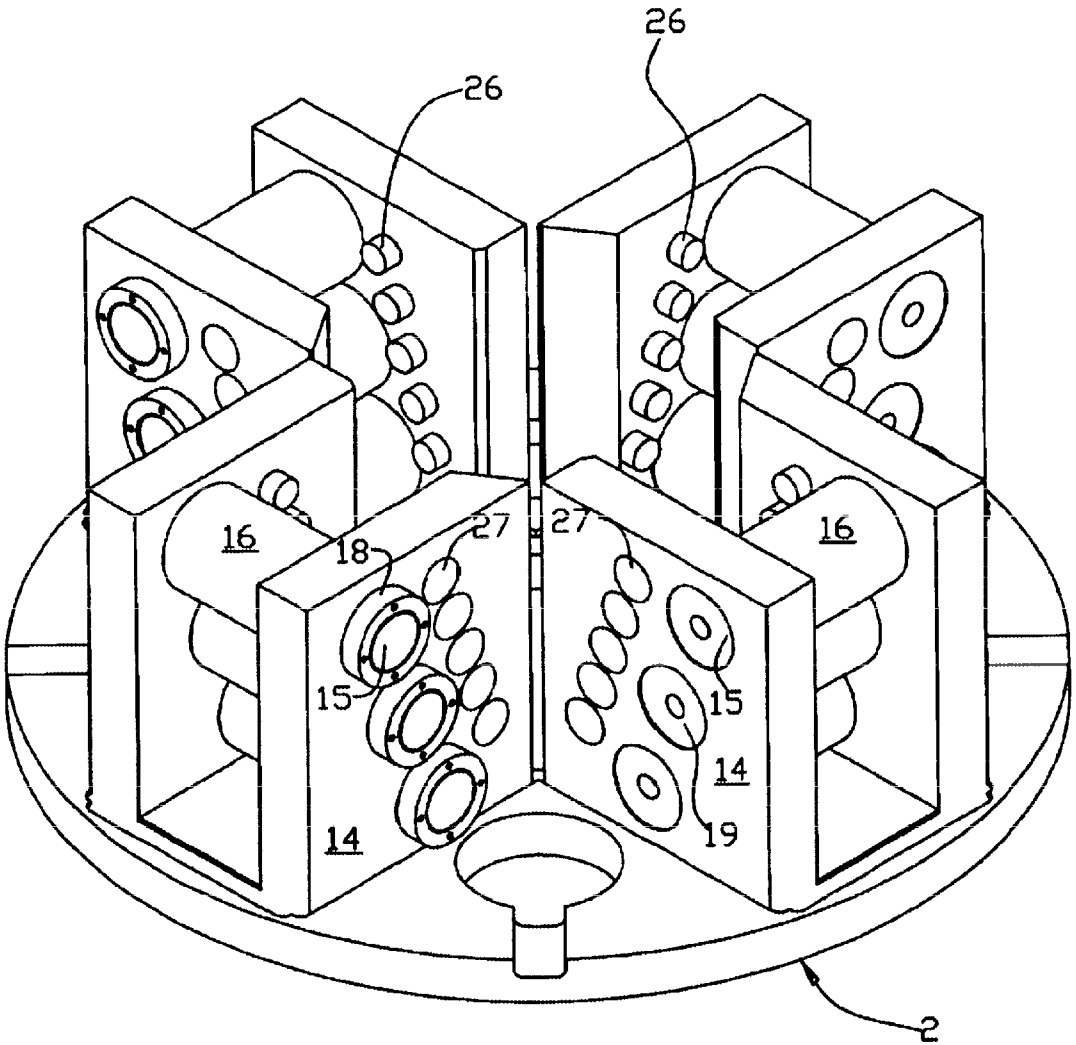
FIG. 4 illustrates the rollers positioned within the slip frames.
Figure 5:
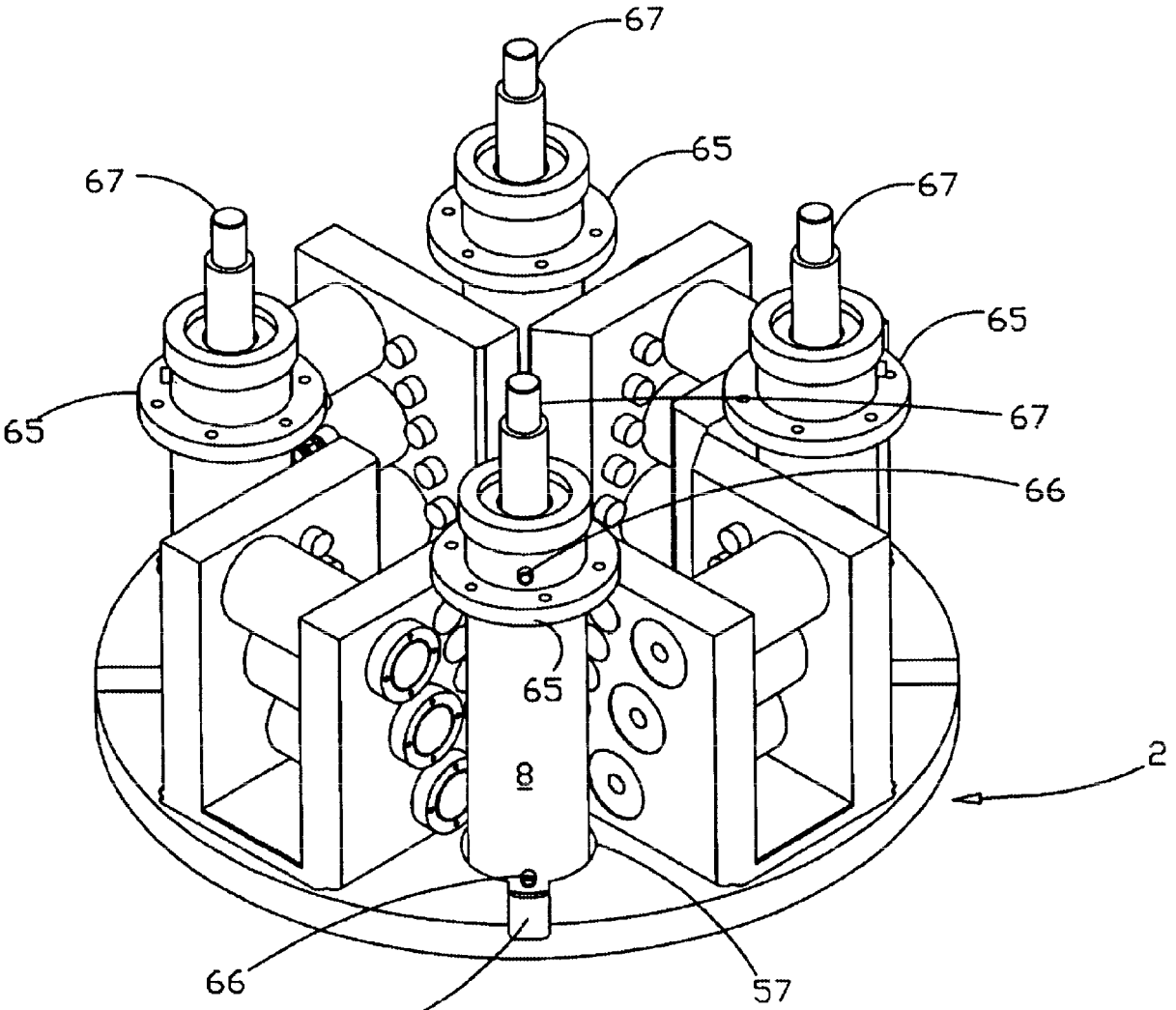

FIG. 5 adds hydraulic cylinders to the view seen in FIG. 4.

Figure 6:
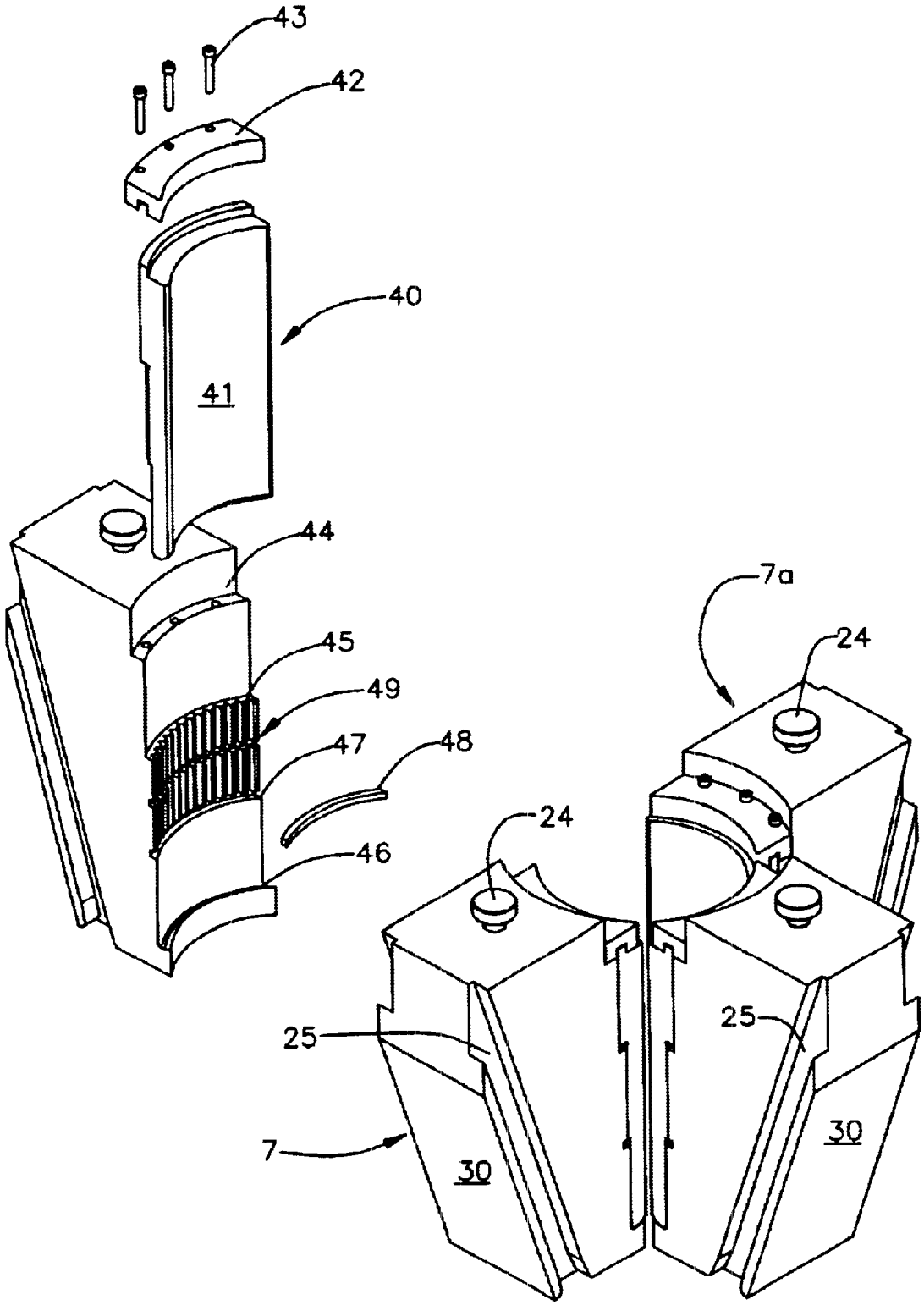

FIG. 6 illustrates the die carriers and die inserts used in the present invention.

Figure 7:
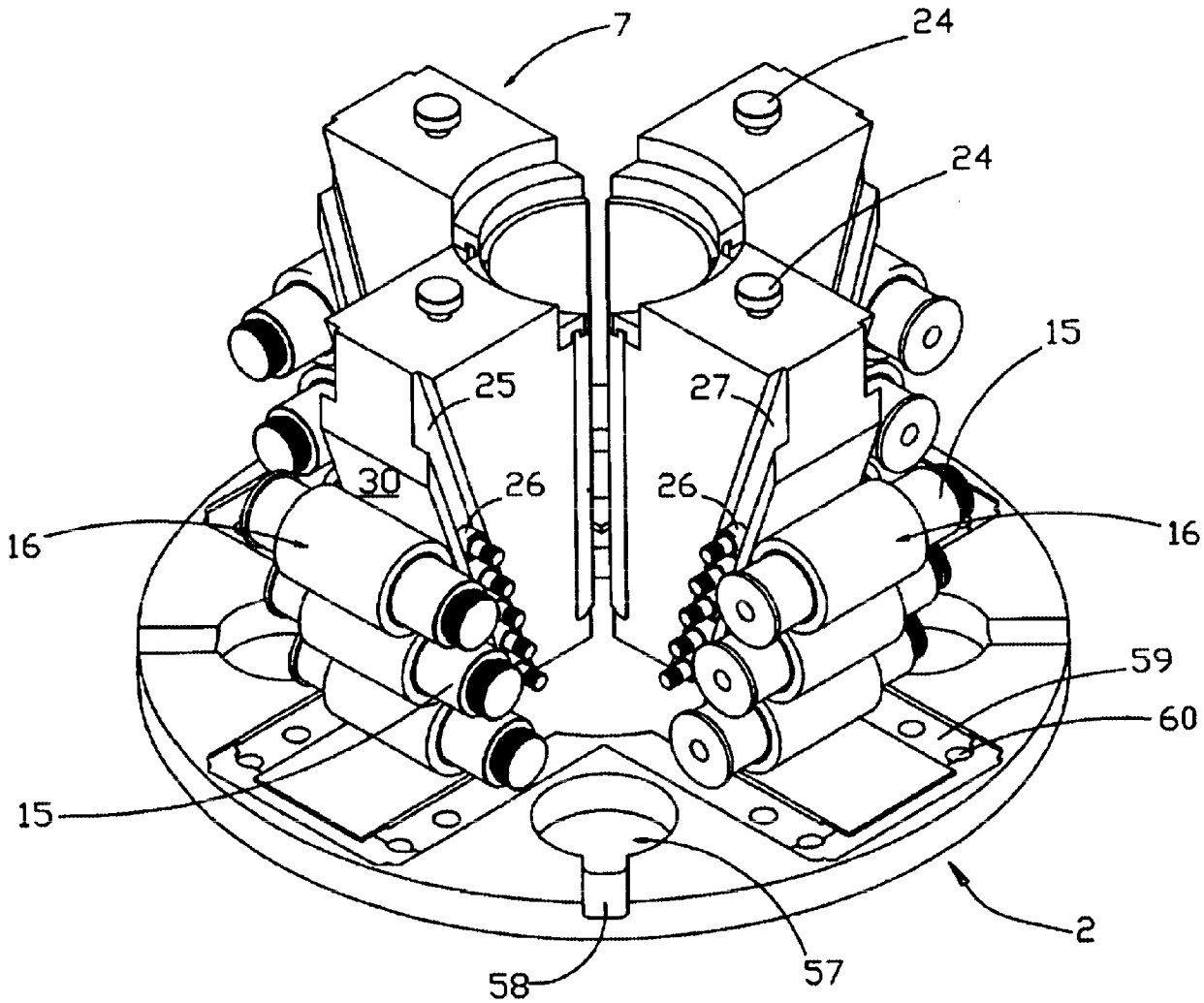

FIG. 7 illustrates the positioning of die carriers and rollers in the present invention.

Figure 8:
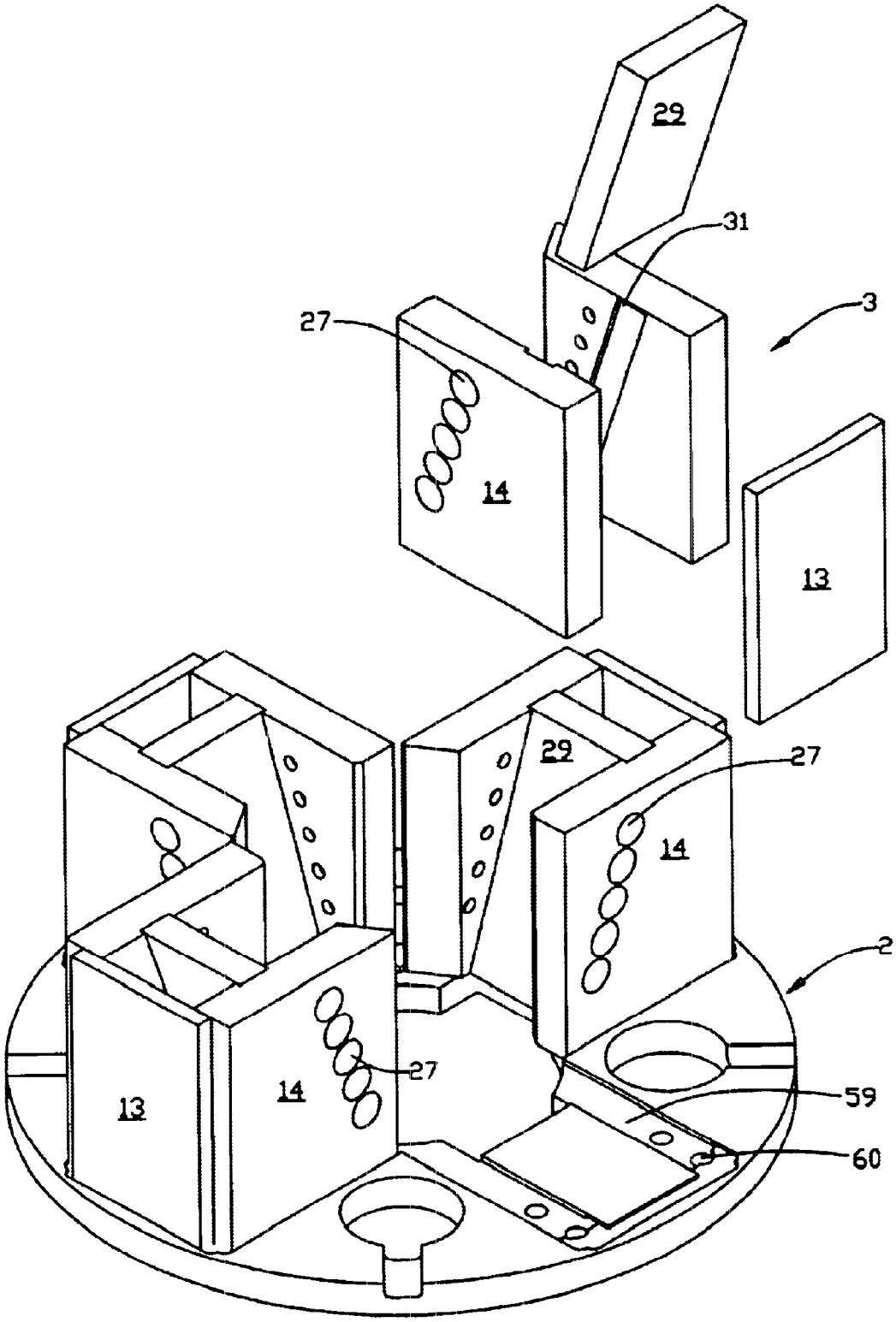

FIG. 8 illustrates an alternative planar slip surface for the present invention.

Figure 9:
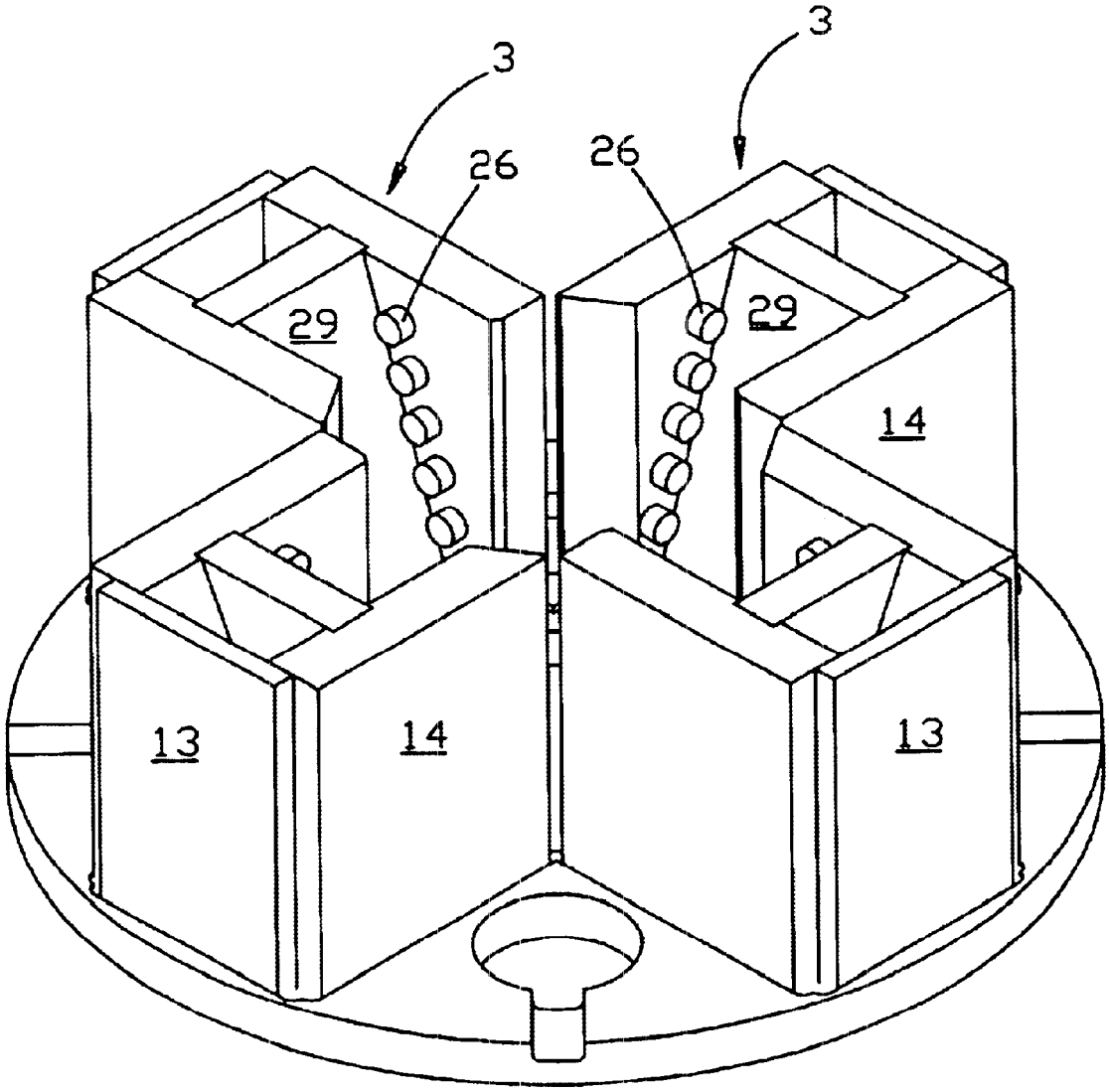

FIG. 9 illustrates the slip surface of FIG. 8, but now including cam followers.

Figure 10:
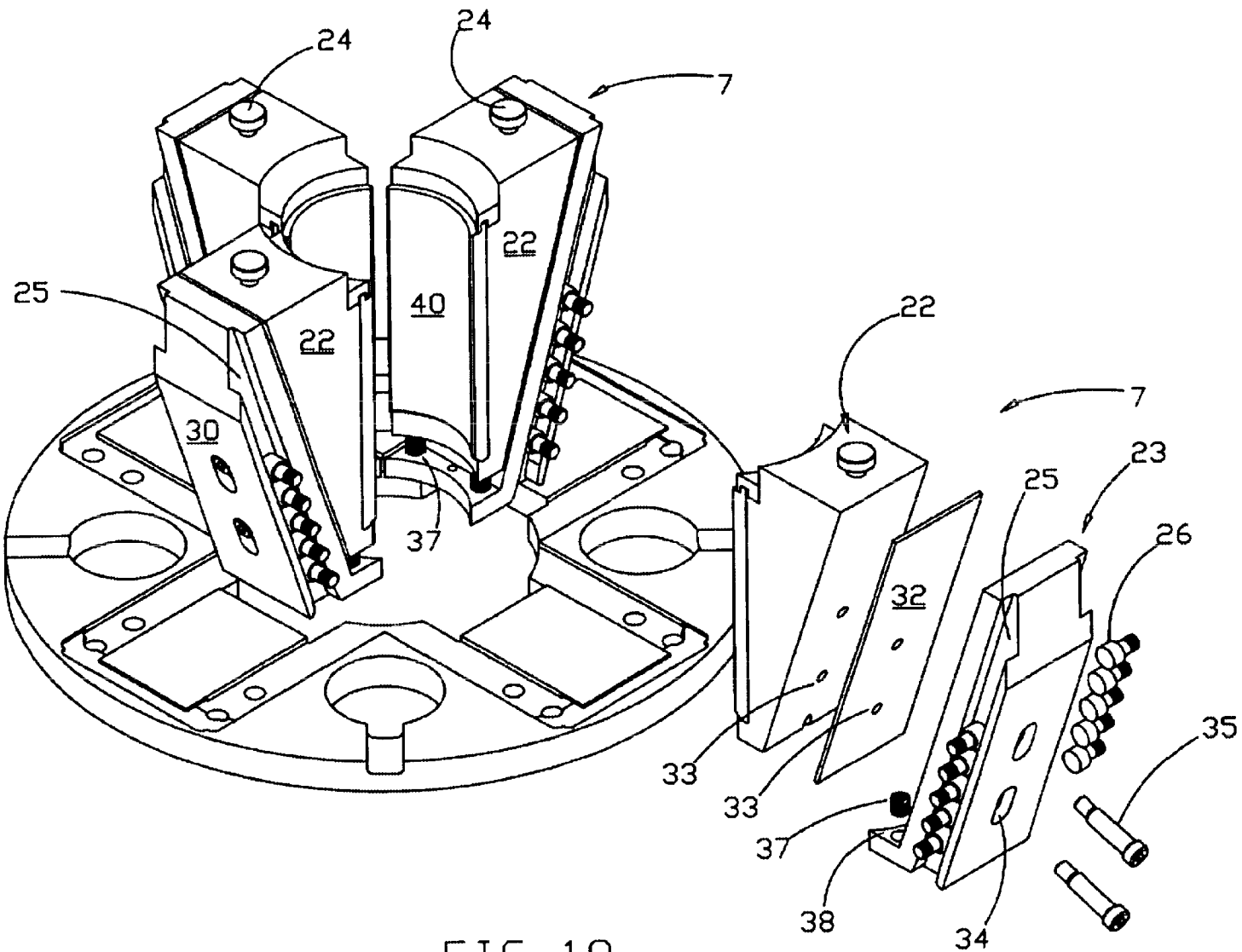

FIG. 10 illustrates the die carrier employed with the slip surface of FIG. 8.

Figure 11A:
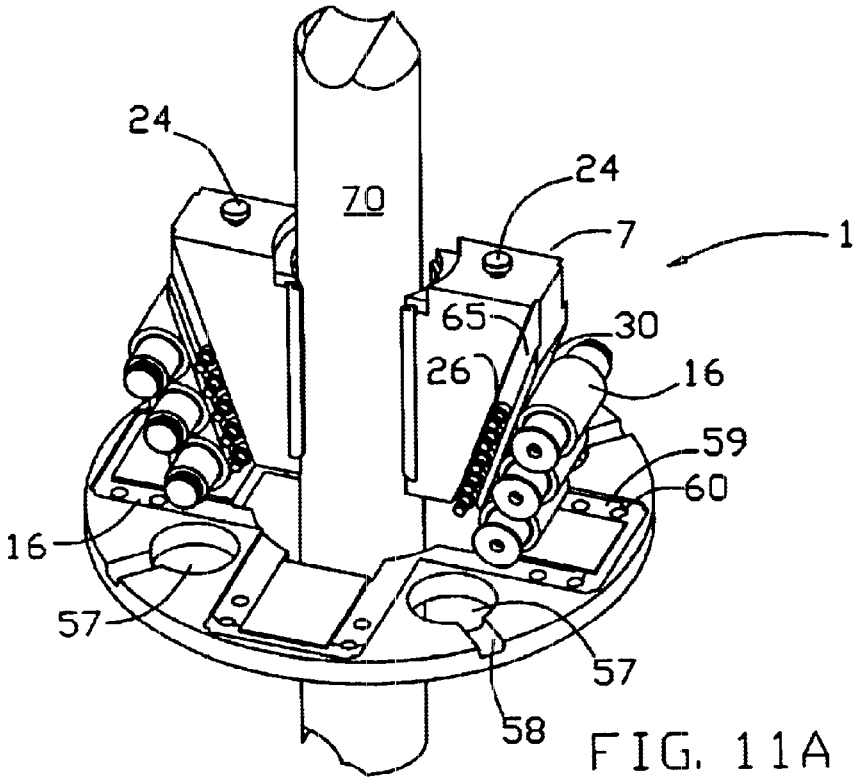

FIG. 11A illustrates the die carriers gripping a tubular member.

Figure 11B:
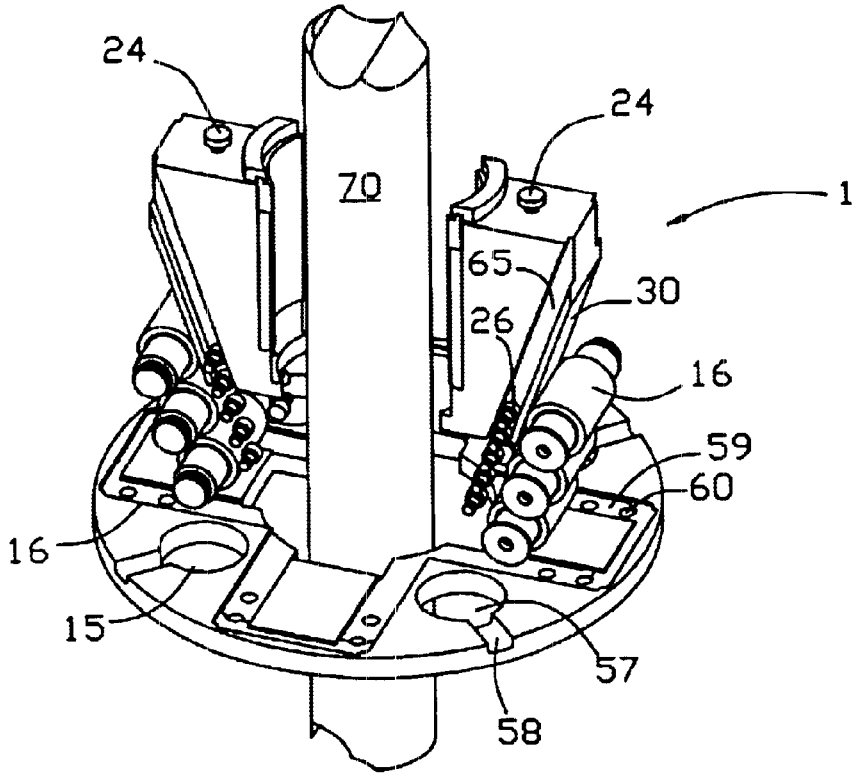

FIG. 11B illustrates the die carriers having released the tubular member.

Figure 12:
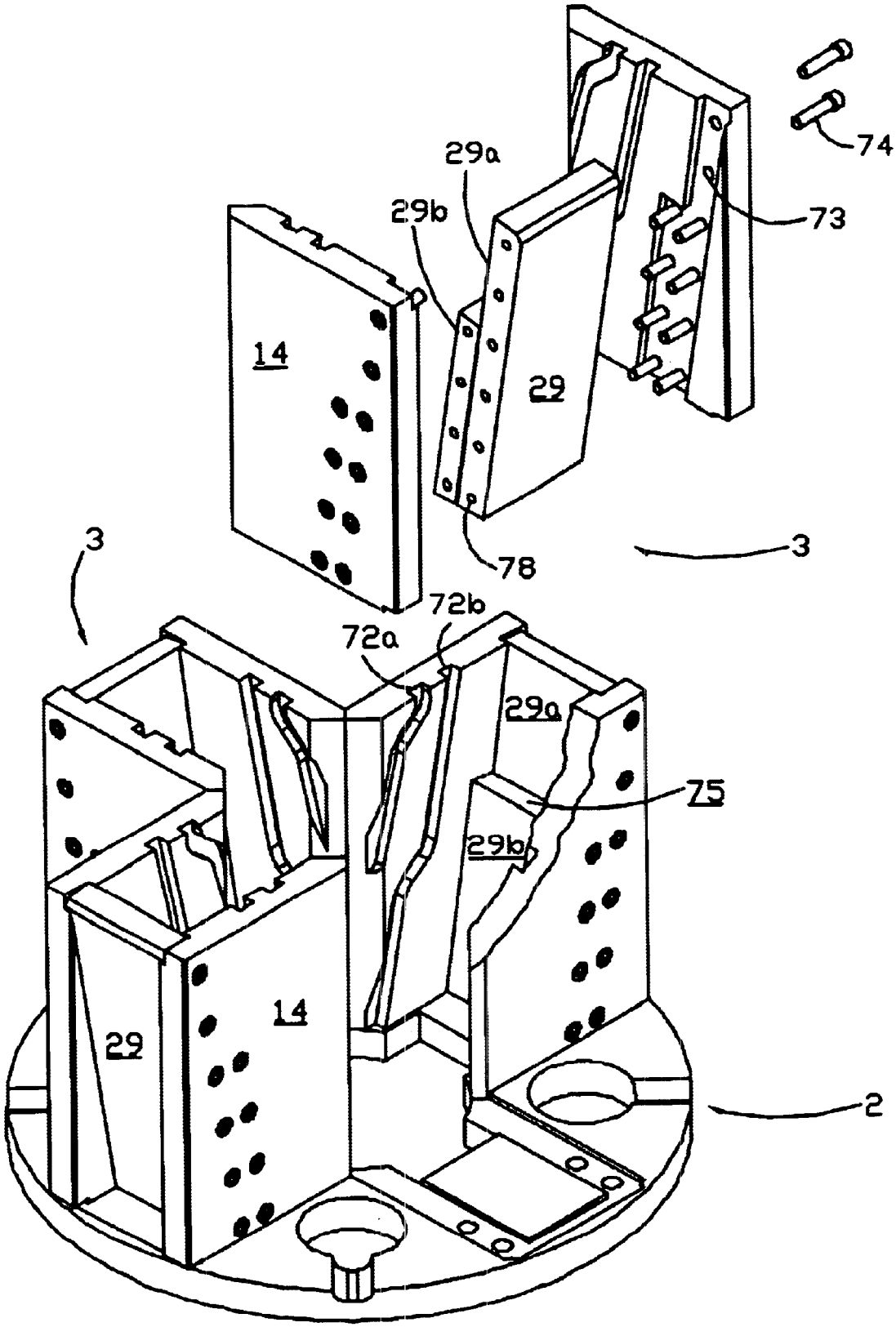

FIG. 12 illustrates an alternative embodiment of the slip frame of the present invention.

Figure 13:
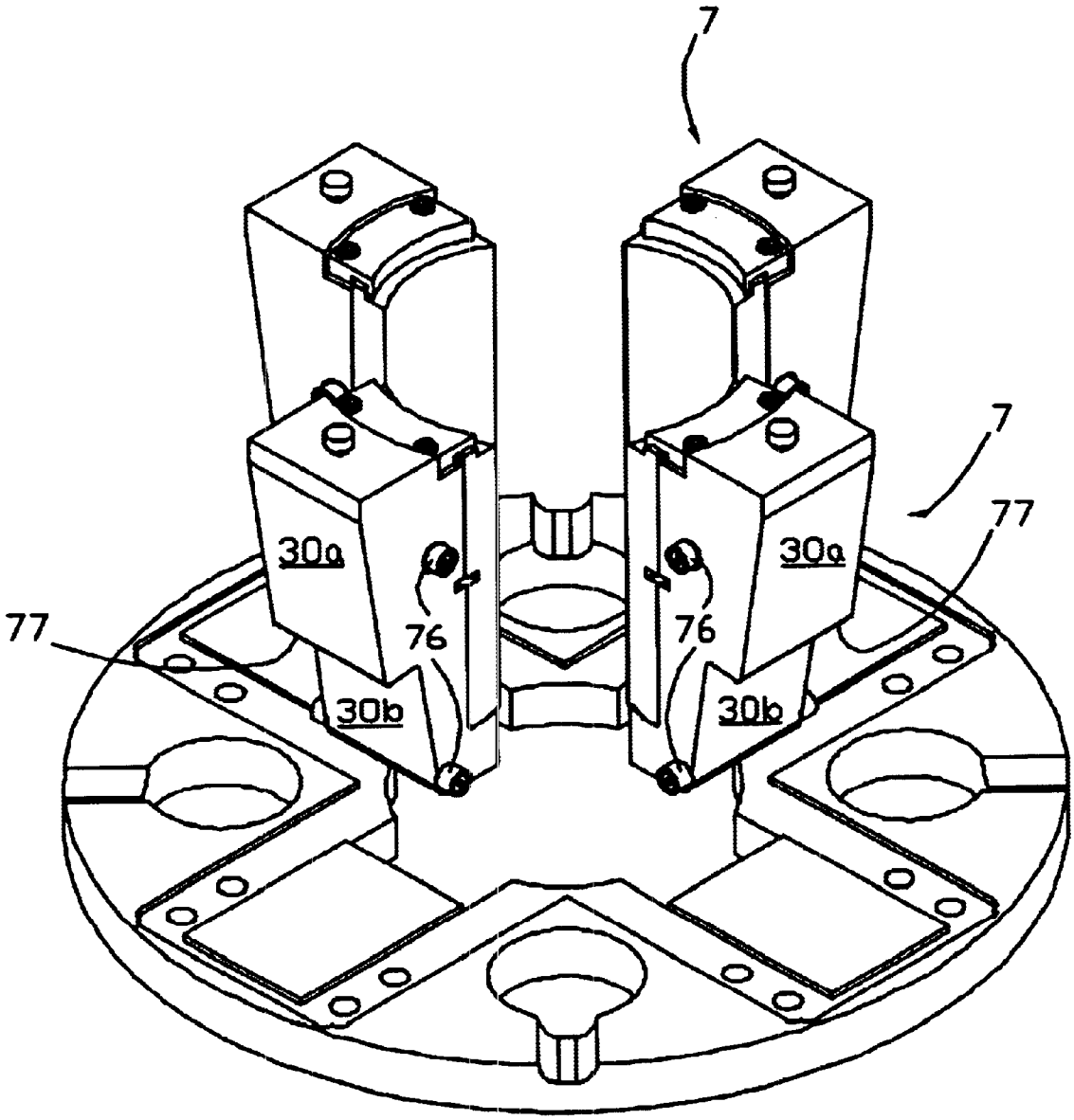

FIG. 13 illustrates the die carriers operating with the slip frame of FIG. 12.

Figure 14:
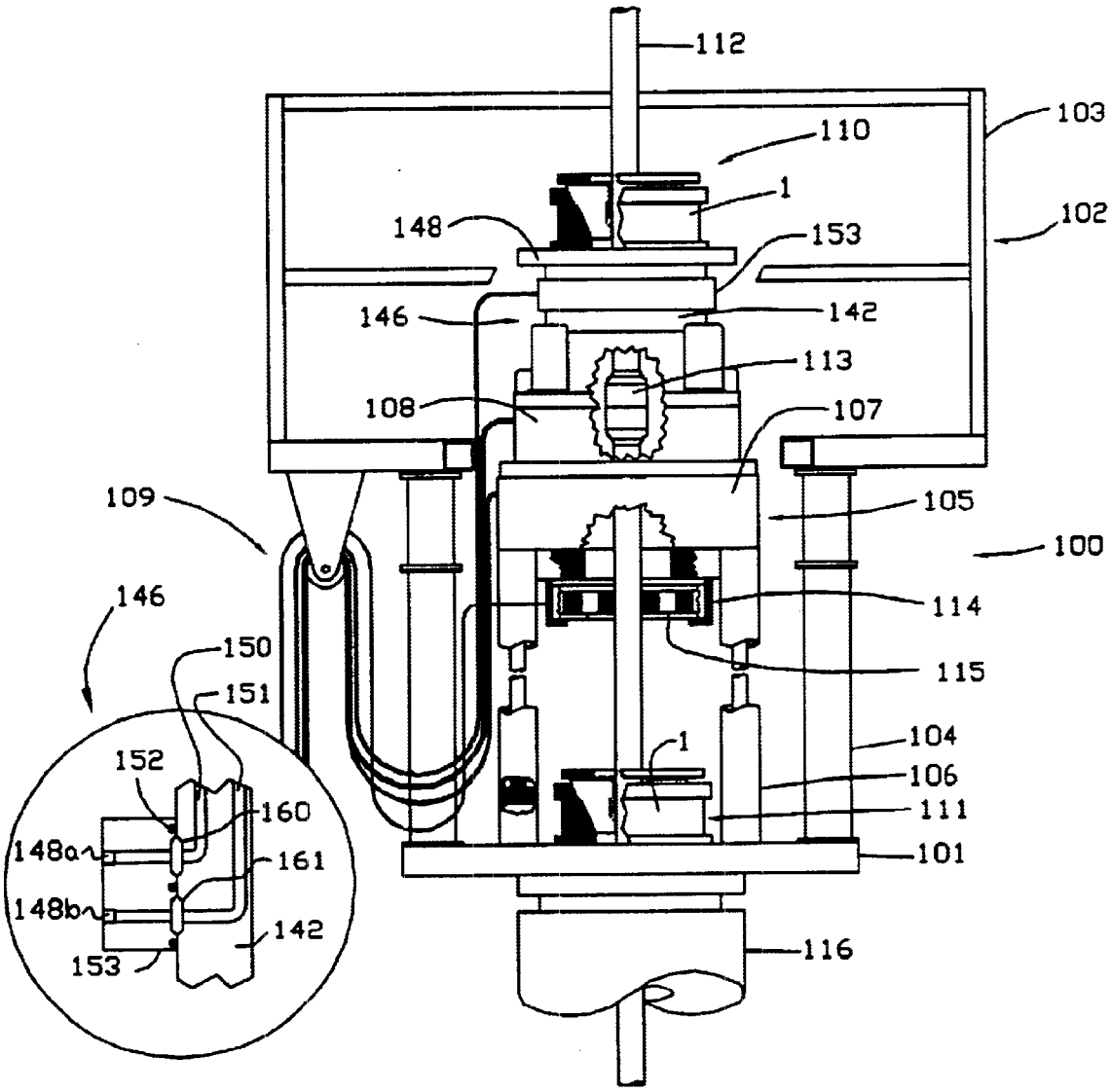

FIG. 14 illustrates a novel snubbing unit utilizing the present invention.

IV. DETAILED DESCRIPTION OF THE INVENTION

Figure 1B:
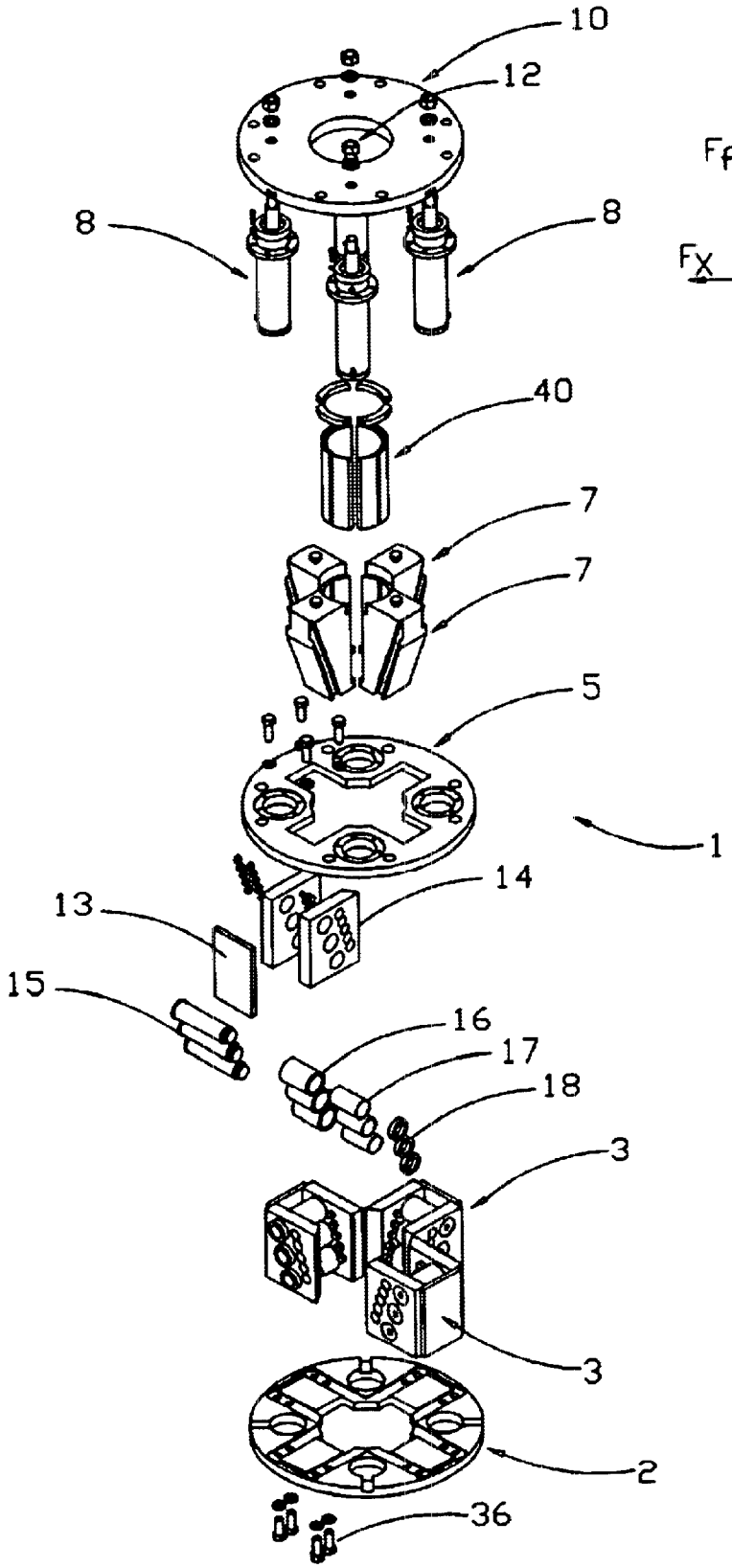
FIG. 1B is an exploded view of the slip assembly of the present invention.
Figure 1A:
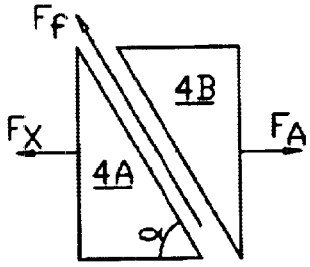
FIG. 1A is a schematic drawing showing the component forces acting within a slip assembly.
Figure 2:
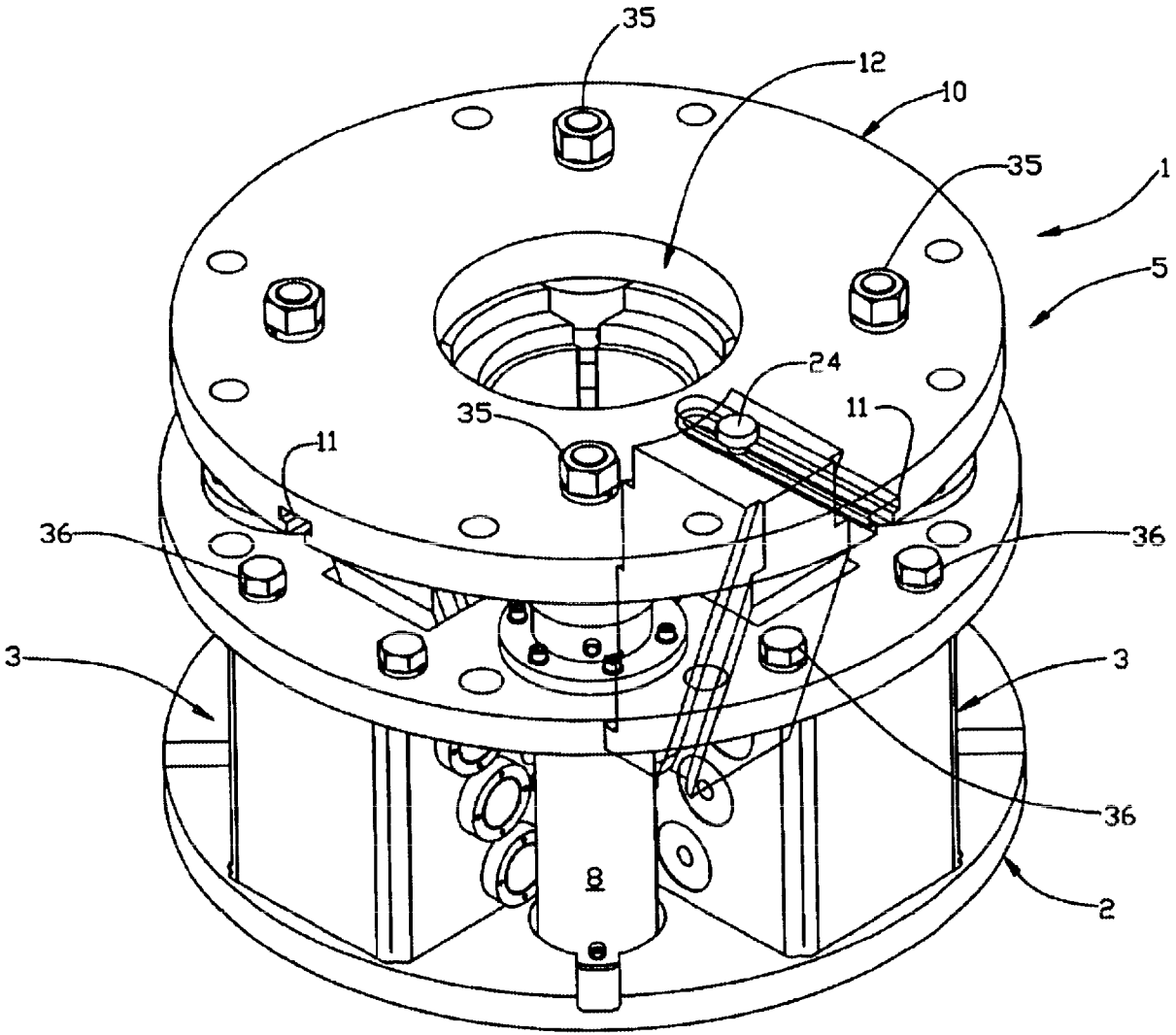
FIG. 2 is an assembled view of the slip assembly of the present invention.
Figure 3:
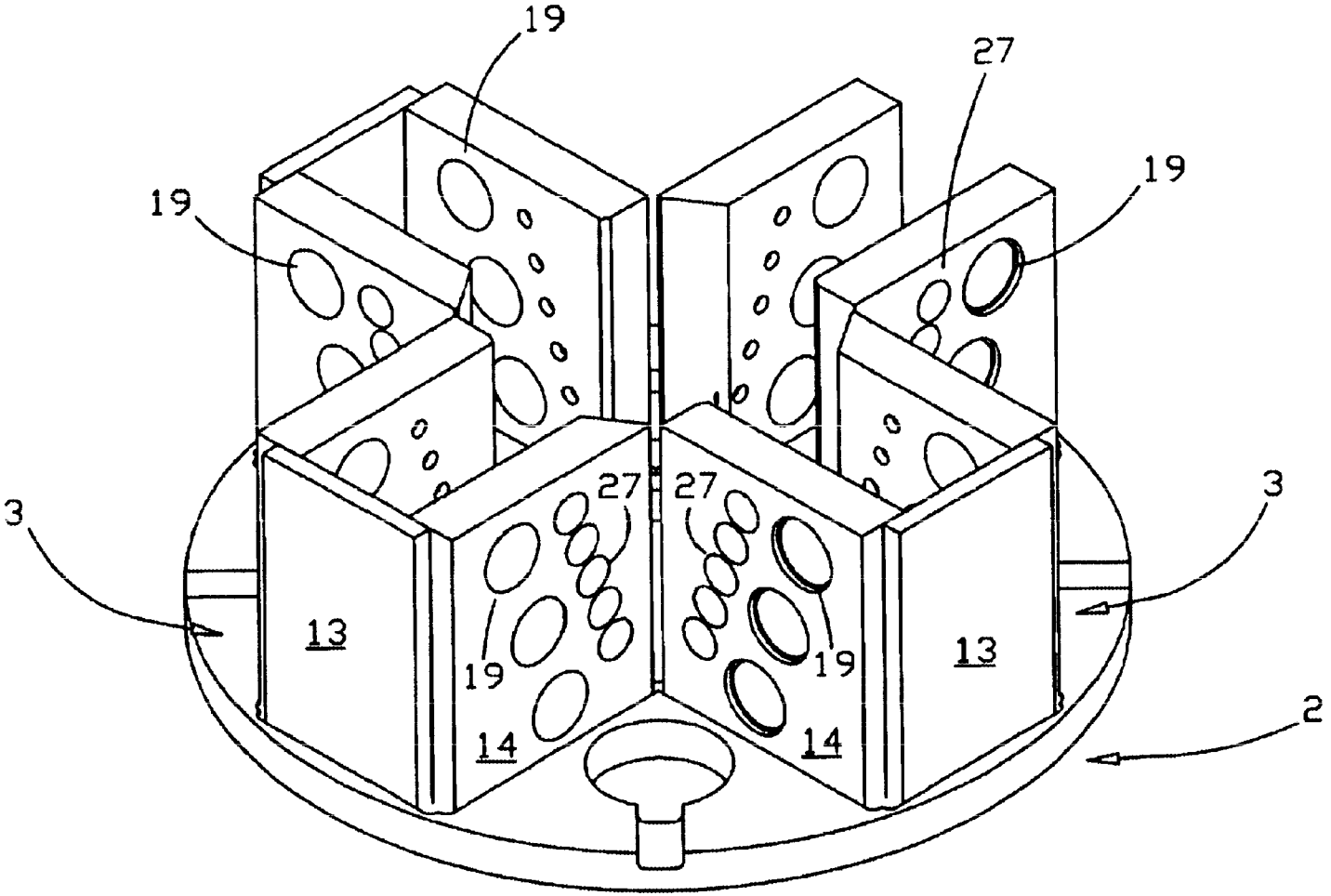
FIG. 3 illustrates the slip frames used in the present invention.

FIG. 1 is an exploded view illustrating the main components of the improved slip assembly 1. These main components include a base plate 2, slip frames 3, cylinder plate 5, die carriers 7, lifting cylinders 8, and slip ring 10. It can be seen that slip ring 10 includes a center aperture 12 and cylinder plate 5 and base plate 2 have corresponding center openings formed therein for allowing a tubular member to travel through the center of slip assembly 1. FIG. 2 illustrates how slip frames 3 and lifting cylinders 8 will be positioned between cylinder plate 5 and base plate 2 and secured into place by bolts 36. FIG. 3 more clearly shows slip frames 73 since with lifting cylinders 8, cylinder plate 5 and slip ring 10 have been removed. Each slip frame 73 will comprise two side frame sections 14 and one rear frame section 13 resting on base in plate 2. As best seen in FIG. 7, base plate 2 will include a depression or footing 59 and bolt apertures 60 to allow frame sections 13 and 14 to be secured to base plate 2 with bolts (see bolts 36 in FIG. 1B) or other conventional means such as welding. FIG. 3 also illustrates how side frame sections 14 will include roller pin apertures 19 and cam follower apertures 27. FIG. 4 shows the roller cylinders 16 positioned between side frame sections 14 with roller pins 15 engaging pin apertures 19 and secured therein with pin nuts 18. While hidden from view in FIG. 4, FIG. 1 suggests how low friction bushings 17 could be inserted between pins 15 and roller cylinders 16. Bushings 17 could be constructed of any suitable material, with one preferred material being Garlock which is sold by Garlock Bearings Inc., 700 Mid Atlantic Parkway, Thorofare, N.J. 08086. In addition to bushings 17, a low friction surface could be formed between pins 15 and roller cylinders 16 by way of ball bearings or pin bearings such as disclosed in U.S. Pat. No. 5,819,605 which is incorporated by reference herein. While the normal steel on steel COF is about 0.08, a Garlock on steel COF is approximately 0.04. It would also be useful to employ other low friction surfaces with varying COF's less than 0.08. Such lower COF's could be less than 0.07 and more preferably less than 0.05.

FIG. 5 illustrates lifting cylinders 8 positioned within cylinder footings 57 on base plate 2. Lifting cylinders 8 will have hose connectors 66 at its top and bottom and cylinder collars 65 to secure cylinders 8 to cylinder plate 5 (as seen in FIG. 2). FIG. 5 also illustrates how lifting cylinders 8 will have piston end 67 which will be connected to slip ring 10 with bolts 35 (see FIG. 2). Base plate 2 will also include hose channels 58 to accommodate hoses extending from cylinders 8. While cylinders 8 maybe any conventional piston and cylinder assembly (either hydraulic or pneumatic), in one preferred embodiment, cylinders 8 are hydraulic cylinders capable of exerting 20,000 pounds force in either an upward or downward direction. Naturally, cylinders 8 are not the only type of lifting device coming within the scope of the present invention. Lifting devices could include items such as power screws or any other type of linear force producing device which may apply adequate force to slip ring 10.

FIG. 6 shows die carriers 7 in greater detail. The rear portion of die carriers 7 includes slip surface 30 and a guide channels 25. The top of die carriers 7 will have a lifting knob 24. The front portion of die carriers 7 will be designed to accommodate die inserts 40 having a gripping surface 41. This front portion will include a first shoulder 44, second shoulder 45, spines 49, keyway channel 47, and bottom lip 46. While not explicitly shown in FIG. 6, it will understood that die inserts 40's rear surface is the mirror image of the die carrier 7's front surface such that die inserts 40 will matingly engage with the front of die carrier 7. Die inserts 40 will be secured in die carriers 7 by way of clips 42 and bolts 43 as suggested by the die carrier 7*a* in FIG. 6. Moreover, a key 48 will be inserted into keyway channel 47 in a manner similar to that disclosed in U.S. Pat. No. 6,253,643 which is incorporated by reference herein. Key 48 will resist upward forces which might tend to dislodge die insert 40 from die carrier 7.

FIG. 7 shows slip frames 3 removed from base plate 2 in order to better illustrate the interaction of die carriers 7 and rollers 16. Die carriers 7 will be supported both by rollers 16 and cam followers 26. It will be understood that cam followers 26 are secured to the inside surface frame side sections 14 by way of apertures 27 as seen in FIGS. 3 and 4. Cam followers 26 will engage cam channels 25 and allow die carriers 7 to ride up and down cam followers 26. On the other hand, the main radial force exerted on die carriers 7 will be by rollers 16 acting against slip surfaces 30. The carrier die lifting knobs 24 will connect carriers 7 to slip ring 10. As suggested in FIG. 2, lifting knobs 24 will be inserted into carrier knob slots 11 which are formed in slip ring 10. This will allow the upward or downward movement of slip ring 10 to also pull die carriers 7 upward or downwards. It will also be understood that carrier knob slot 11 allows for lateral movement of die carriers 7 as they move toward and away from a tubular member when lowered or raised.

The operation of slip assembly 1 may best be understood with reference to FIGS. 11A and 11B. FIG. 2 shows slip assembly 1 with lifting cylinders 8 pulling slip ring 10 into the lowered position and thus as seen in FIG. 11A, die carriers 7 are in the lowered or activated position such that the die inserts 40 on die carriers 7 will be gripping a tubular member 70 positioned within slip assembly 1. As slip ring 10 presses die carriers 7 downward, slip surface 30 will travel down rollers 16. Because the row of rollers 16 in each slip frame 3 are positioned in an inclined plane orientation, die inserts 40 on die carriers 7 will move inwardly to grip tubular 70 in slip assembly 1. Likewise, when slip ring 10 raises die carriers 7, cam followers 26 riding in channel 25 will force die carriers 7 away from the tubular, thereby releasing the tubular from the grip of the dies as seen in FIG. 11B. As mentioned, the rollers 16 form a planar slip surface. In other words, all points on the slip surface lie in the same plane. This may be distinguished from the prior art slip bowls which form a curved or arcuate slip surface. As discussed above, the prior art slip bowls' curved surface rendered it less reliable in handling the different tolerances in tubular diameters. However, when the slip surface and die carrier both are planar as in the present invention, the difference in tolerances presents no disadvantages whatsoever. Additionally, a preferred embodiment of the present invention will employ a slightly less steep slip slope than the prior art. Viewing, FIG. 1A, the angle a should be approximately 70 degrees rather than the 80 degrees used for conventional slip surfaces.

Also contrary to the prior art where the slip surface of the die carrier slid down the sloped surface of the slip bowl (i.e. a sliding steel on steel contact with a COF of about 0.08), the rollers 16 with bushings 17 provide a much lower coefficient of friction acting on the slip surface 30 of die carriers 7. This results in the application of much greater radial force when the pipe is being gripped. It has been found that the slip system of the present invention may apply at least three times the radial force on the pipe which conventional slip assemblies which operate with sliding steel on steel slip surfaces.

Another advantage over the prior art is the securing of the die carriers 7 in separate slip frames 3. The distance between the interior walls of side frame sections 14 is only slightly greater than the width of die carriers 7. Thus, practically no lateral movement of die carriers 7 is possible. In the instance where it is desired to mount slip assembly 1 on a rotary table or another source of torque, slip frames 3 allow slip assembly 1 to be used in transferring torque to the tubular member being gripped. It will be understood that the application of torque to a tubular member will result in the placing of lateral forces on die carriers 7. The strong and rigid construction of slip frame 3 insures die carriers 7 will be fixed against such lateral forces. This can be distinguished from prior art slip bowls where lateral forces on the die carriers could shift the die carriers' position in the slip bowl, possibly damaging the pipe, die carriers, and/or bowl.

Another manner of forming low coefficient of friction surfaces is seen in FIGS. 8–10. FIG. 8 illustrates slip frames 3 which have rear frame section 13 and side frame sections 14 positioned in frame footings 59 on base plate 2 as seen in the previously described embodiment. However, instead of rollers 16, the slip surface is formed from block 29. The interior surface of side frame sections 14 will include a guide channel 31 which will position block 29 at the desired slope for the slip surface. Since block 29 is flat, it obviously forms a planar slip surface. FIG. 9 illustrates how cam follows followers 26 will be positioned along the slip surface in the same manner as previously described. The die carriers 7 seen in FIG. 10 differ from those of FIG. 6. The die carriers of FIG. 10 comprise two separate sections, die carrier block 22 and die carrier frame 23. Carrier block 22's front face is identical to that seen in FIG. 6 and will secure the die insert 40 to carrier block 22 in the same manner as described in reference to FIG. 6. Additionally, carrier block 22 will include lifting knob 24 as previously described. However, the rear of carrier block 22 is a planar surface with two threaded bolt apertures 33. Carrier frame 23 is similar to previous embodiments in that its rear surface comprises a sloping slip surface 30 and guide channels 25 formed in the sides of carrier frame 23 are for engaging cam followers 26. The front of carrier frame 23 is different in that it will include a carrier block footing 38 which extends outwardly and includes a biasing device such as spring 37 positioned thereon. It will be understood that carrier block footing 38 may include a bore hole in which spring 37 may be partially inserted. Additionally, the slip surface 30 of carrier frame 23 will include elongated bore holes 34 which are sized to allow bolts 35 to be inserted into holes 34 deeply enough that the heads of bolts 35 do not protrude out of bore holes 34 and into the plane of slip surface 30.

The purpose of dividing die carrier 7 into carrier block 22 and carrier frame 23 is to allow for the creation of a low friction surface between carrier block 22 and carrier frame 23. In the embodiment of FIG. 10, the low friction surface is created by the positioning of a low friction insert 32 between carrier block 22 and carrier frame 23. In one preferred embodiment, low friction insert 32 is a thin rectangular section of Garlock. Low friction insert 32 will have apertures 33 such that bolts 35 may be inserted through low friction insert 32 and engage threaded apertures 33 in carrier block 22.

In operation, it will be understood that the elongated bore holes 34 will allow carrier block 22 to have a limited range of upward and downward movement relative to carrier frame 23. When die carriers 7 are placed in the slip frames 3 seen in FIG. 9, the carrier frame's slip surface 30 will slide on slip block 29. This is similar to the prior art in that it is a steel on steel sliding surface. However, there is still the important difference from the prior art in that the slip surfaces are planar in nature rather than curved or arcuate. Viewing FIG. 10, it can be visualized how the downward movement of die carriers 7 within the slip frames would bring the die inserts 40 into contact with a tubular member positioned in slip assembly 1. Until die inserts 40 contacted the tubular member, the downward force of slip ring 10 on carrier block 22 will cause carrier frame 23 to travel with carrier block 22. While the slip surface 30 of carrier frame 23 will be making a comparative high COF steel on steel sliding contact with slip block 29 (see FIG. 9), springs 37 will have a sufficiently high spring constant to prevent springs 37 from being compressed and carrier block 22 moving relative to carrier frame 23. However, once die inserts 40 contact the tubular member, it only requires a very small amount of additional downward movement to apply a large radial force on the tubular member. At this point, the compressive force of springs 37 is overcome and carrier block 22 begins to move downward independently of carrier frame 23. Because low friction insert 32 is positioned between carrier block 22 and carrier frame 23, there is a much lower COF resisting the downward movement of carrier block 22 relative to carrier frame 23 and a significantly larger radial force may be applied to the tubular member. Again, it will be understood that the actual downward movement of carrier block 22 need only be very slight to generate whatever radial load on the tubular member is desired. Thus, the range of movement allowed by the elongated bore holes 34 is more than sufficient. When the die carriers 7 are raised and die inserts 40 move out of engagement with the tubular member, springs 37 will insure that carrier block 22 is again moved to its highest position relative to carrier frame 23. This will insure that carrier block 22 will have some range of downward movement the next time it engages a tubular member.

Another embodiment of the present invention is illustrated in FIGS. 12 and 13. FIG. 12 shows a base plate 2 such as described above, but with substantially different slip frames 3. The slip frames 3 of FIG. 12 do have side frame sections 14, but omit rear frame sections 13 seen in previous figures. Instead, the die frame slip surface 29 is secured to side frame sections 14 by way of bolts 74 passing through apertures 73 in side frame sections 14 and engaging threaded bolt apertures 78. The front of slip surface 29 will further comprise a first or upper slip surface 29*a* and a second or lower slip surface 29*b*. It can be seen that upper slip surface 29*a* is radially offset from lower slip surface 29*b* and that ledge 75 is formed at the transition between the two slip surfaces. Also, both slip surfaces 29*a* and 29*b* will be planar surfaces as defined above. Additionally, the inside wall of side frame sections 14 will include an upper guide channel 72*a* and a lower guide channel 72*b* which are explained in more detail below.

FIG. 13 illustrates the corresponding die carriers 7 which will engage the slip frames 3 of FIG. 12. Die carriers 7 will also have upper and lower slip surfaces 30*a* and 30*b* which correspond to slip surfaces 29*a* and 29*b*. It can also be seen how a shoulder 77 is formed in the transition from slip surface 30*a* to 30*b*. Additionally, die carriers 7 will have two followers 76 formed on each side. In one embodiment, followers 76 are simply cylinder shaped knobs extending from the side of die carriers 7 and could be constructed from a suitable material such as brass. Alternatively, followers 76 could be of the rolling cam type described above in reference to FIG. 7.

The operation of the slip assembly of FIGS. 12 and 13 will be readily apparent. When die carriers 7 are positioned in slip frames 3, the followers 76 will engage guide channels 72*a* and 72*b*. When die carriers 7 are moved to their lowered position (such as by the slip ring and cylinders described above) to engage a tubular, die slip surface 30*a* will engage frame slip surface 29*b*. While the radial force placed on the tubular maybe released by moving the slips a relatively small distance upwards, there will be instances where it is desired to create substantially more space around the tubular such that downhole tools, well testing equipment, drill collars and the like maybe lifted past die carriers 7. Therefore die carrier 7 is configured such that it may be "stepped back" by raising die carrier 7 until surface 30*a* contacts surface 29*a*, surface 30*b* contacts surface 29*b*, and shoulder 77 rests on ledge 75. It can be seen in FIG. 12 how guide channels 72*a* and 72*b* are formed to direct die carriers 7 into and out of this position. To move die carriers 7 back into the gripping position, downward force is exerted and die carriers will follow guide channels 72*a* and 72*b* in order to bring slip surface 30*a* into contact with surface 29*b*. While not explicitly shown in FIGS. 12 and 13, it will be understood that the carrier dies 7 seen in those figures could be modified to comprise a carrier block 22, a carrier frame 23, and a low friction insert 32 such as seen in FIG. 10. The only practical difference being that the carrier frame would include the two slip surfaces 30*a* and 30*b* and would also include followers 76.

While the foregoing description illustrates two alternate embodiments, the present invention is not limited to these particular configurations. For example, while the embodiments shown in the figures illustrate the use of four slip frames 3, fewer or more slip frames 3 could be employed. It is only necessary that the slip frames are positioned in a sufficiently opposing configuration that they may effectively apply the necessary gripping force to a tubular member.

An alternative embodiment of the present invention is seen in FIG. 14. FIG. 14 illustrates an improved snubbing unit 100 which incorporates the slip assembly 1. Snubbing unit 100 is shown positioned on blowout preventor 116 and will generally comprise a base 101, basket support columns 104, basket 102 (with basket railing 103), and lifting assembly 105. Lifting assembly 105 will include a lifting platform 107 supported by hydraulic cylinders 106 which will raise and lower lifting platform 107. Positioned atop lifting platform 107 will be a rotary table 108 with a first slip assembly 110 connected thereto. Rotary table 108 maybe any conventional torque generating device which may be position atop lifting assembly 105. Many different types of rotary tables are well known in the drilling industry and could be employed in snubbing unit 100, although the rotary table shown in FIG. 14 is hydraulically driven. Hydraulic fluid maybe supplied to the rotary table 108 through hydraulic cables 109 and to slip assembly 110 through a conventional hydraulic swivel. Hydraulic swivel assemblies are well known in the art and one such hydraulic swivel assembly is utilized in a rotary table available from Superior Manufacturing, Inc., located at 4225 Hwy. 90 East, Broussard, La., under the tradename Clincher Hydraulic Rotary Table, model no. HRT-20B (although the model number may vary based on the rotary table's size). Another suitable rotary table is available from Hydra Rig located at 6000 Berry Street, Forth Worth, Tex., 76119. The detailed insert shown in FIG. 14 schematically illustrates how conventional hydraulic swivels supply fluid to slip assembly 110. Hydraulic swivel assembly 146 allows a fixed hydraulic fluid line 148 to transfer fluid through the rotating hub 142. While the main FIG. 14 only shows a single fluid line 148, the detailed insert more precisely shows line 148 divided into dual internal fluid lines 148*a* and 148*b*. Swivel assembly 146 includes a hydraulic swivel ring 153 which encircles rotating hub 142, but is held stationary (by a structure hidden from view in FIG. 14) while rotating hub 142 is attached to rotary table 108. Hydraulic swivel assembly 146 will further have two annular passages 160 and 161 formed at the junction of swivel ring 153 and rotating hub 142. It should be understood that passages 160 and 161 are annular in the sense that they form a space completely encircling the circumference of rotating hub 142. Because passage 160 is annular, passage 160 may maintain fluid communication between internal fluid lines 148*a* and 150 throughout rotating hub 142's entire range of rotation. Likewise, it can be seen that annular passage 161 maintains communication between internal hydraulic lines 148*b* and 151 in the same manner. Seals 152 will ensure fluid does not escape from the point where swivel ring 153 mates with rotating hub 142. Internal line 150 will typically be attached to an external line (not shown) as internal line 150 exits rotating hub 142 and that external line will connect to an inlet 66 of cylinders 8 (see FIG. 5). As is well known in the art, line 148*a* may direct fluid to the upper inlet 66 on cylinder 8 (thus retracting cylinder 8) while line 148*b* may direct fluid to the lower inlet 66 on cylinder 8 (thus extending cylinder 8). A second slip assembly 111 is shown positioned upon base 101. It will be understood that all elements positioned along the center line of snubbing unit 100 will have a central aperture allowing a pipe or other tubular member 112 to pass therethrough. A cut-away section shows the tubular joint 113 connecting two successive tubular members 12. A fuller description of snubbing units and their operation may be seen in references such as U.S. Pat. No. 4,085,796 to Council, which is incorporated by reference herein.

Conventional snubbing units generally include a power tong and a backup power tong. Additionally, the upper slip assembly will be positioned upon a swivel base which allows the slips to rotate when the tubular string rotates. In operation, the upper slip assembly will grip the tubular string and the lower slip assembly will release the tubular. Lifting devices such as hydraulic cylinders will lift the upper slip assembly in order to position the tubular joint between the power tong and backup power tong. The power tong will apply torque to the tubular above the joint while the backup tong holds the tubular against rotation below the joint. As is well known in the art, alternative gripping and releasing of the slip assemblies in conjunction with raising and lowering of the upper slip assembly allows successive joint sections to be positioned between the power tong and backup tongs. In this manner, successive sections of tubulars in the string maybe made-up or broken out.

Prior art snubbing units generally require the use of power tongs to rotate the pipe because prior art slip assemblies are intended to only resist the weight of the tubular string and such slip assemblies cannot effectively apply torque (or resist torque applied) to a tubular member. However, in the novel snubbing unit 100 illustrated in FIG. 14, first slip assembly 110 may be one of the improved slip assemblies 1 disclosed in FIGS. 1–13. Further, first slip assembly 110 is fixed to rotary table 108 such that torque may be applied to slip assembly 110. As discussed above, the improved slip assemblies 1 are well adapted to applying torque (or resisting torque applied) to the tubular being gripped. Thus, when slip assembly 110 grips tubular 112 as seen in FIG. 1, slip assembly 110 may apply torque to tubular 112 in the same manner as done by power tongs in prior art snubbing units.

One embodiment of snubbing unit 100 will include backup 115 tong positioned on snubbing unit 100 and preferably connected underneath lifting assembly 107. In FIG. 14, brackets 114 will be fixed to lifting assembly 107 and backup tong 115 slid between brackets 114. In this manner, back-up tong 115 will be removably positioned on snubbing unit 100. Backup tong 115 may be any conventional backup tong such as that disclosed in U.S. Pat. No. 4,649,777 to Buck which is incorporated by reference herein. Backup tong 115 will hold the lower tubular 112 against rotation while first slip assembly 110 applies torque to the upper tubular 112. In this embodiment of snubbing unit 100, second slip assembly 111 may be any conventional slip assembly.

An alternate embodiment of snubbing unit 100 will not include backup tong 115. However, in this embodiment second slip assembly 111 will be an improved slip assembly 1 as described above. Second slip assembly 111 will be fixed to base 101 such that it cannot rotate. In this manner, second slip assembly 111 may perform the function of backup power tong 115 and hold the lower tubular 112 stationary against the torque applied to upper tubular 112 by first slip assembly 110.

Those skilled in the art will readily comprehend the advantage provided by snubbing unit 100. In one embodiment, snubbing unit 100 eliminates the need for an expensive power tong. In another embodiment, snubbing unit 100 eliminates the need for either a power tong or a backup tong. Furthermore, while FIG. 14 shows a specific arrangement of slip assemblies, backup tongs and other components, the invention includes many variations of the design shown in FIG. 14. For example, it is possible that the second slip assembly 111 could be positioned on a rotary table at base 101 and first assembly 110 be fixed against rotation. Similarly, backup tong 115 could be positioned above lift platform 107 rather than below it. All such variations are intended to come within the scope of the following claims.

I claim:

1. An improved snubbing unit comprising:

a. a snubbing unit base;

b. a lifting assembly having a platform positioned above said base;

c. a rotary table positioned on said snubbing unit;

d. a first slip assembly including:

i. a base plate with a center aperture formed therein, ii. at least two opposing slip frames positioned on said base plate, each of said slip frames including a first planar slip surface and a second planar slip surface radially offset from said first slip surface and side frame sections;

ii. a die carrier positioned within each of said slip frames, each of said die carriers also including first and second radially offset rear planar surfaces corresponding to said first and second slip surfaces of said slip frames;

iii. upper and lower guide channel/follower assemblies positioned between said side frame sections and said die carriers; and e. a second slip assembly positioned on said snubbing unit.

2. The improved snubbing unit according to claim 1, further including a back-up power tong removably positioned on said snubbing unit.

3. The improved snubbing unit according to claim 1, wherein said second slip assembly includes:

i. base plate with a center aperture formed therein, ii. at least two separate slip frames positioned on said base plate around said center aperture, each of said slip frames including a slip surface; and iii. a die carrier positioned within each of said slip frames, each of said die carriers also including a surface for engagement with said slip surfaces of said slip frames.

4. The improved snubbing unit according to claim 1, wherein said rotary table is positioned on said lifting platform and second slip assembly is positioned below said lifting platform.

5. The improved snubbing unit according to claim 4, wherein a backup power tong is positioned between said rotary table and said second slip assembly.

6. The improved snubbing unit according to claim 4, wherein said lifting assembly includes a plurality of lifting jacks to raise and lower said lifting platform.

7. The improved snubbing unit according to claim 6, wherein a said lifting jacks comprise hydraulic cylinders connected between said base and said lifting platform.

8. The improved snubbing unit according to claim 7, wherein said second slip assembly includes:

i. a base plate with a center aperture formed therein, ii. at least two separate slip frames positioned on said base plate around said center aperture, each of said slip frames including a slip surface; and iii. a die carrier positioned within each of said slip frames, each of said die carriers also including a surface for engagement with said slip surfaces of said slip frames.

9. The improved snubbing unit according to claim 8, wherein said slip surface of said second slip assemblies is a planar slip surface.

10. The improved snubbing unit according to claim 9, wherein said first and second slip surfaces are substantially rectangular in shape.

11. The improved snubbing unit according to claim 10, wherein a slip ring is connected to said die carriers and a lifting device raises said slip ring relative to said base plate.

12. The improved snubbing unit according to claim 9, wherein said slip surfaces have an effective coefficient of friction less than about 0.07.

13. The improved snubbing unit according to claim 9, wherein said slip surfaces are planar and each of said die carriers also includes a planar surface for engagement with said slip surfaces.

* * * * *